US010151067B2

(12) United States Patent
Maurice

(10) Patent No.: US 10,151,067 B2
(45) Date of Patent: Dec. 11, 2018

(54) HYBRID CONTINUOUS INDEXING TAMPER VEHICLE

(71) Applicant: HARSCO TECHNOLOGIES LLC, Fairmont, MN (US)

(72) Inventor: Peter Robert Maurice, Camp Hill, PA (US)

(73) Assignee: HARSCO TECHNOLOGIES LLC, Fairmont, MN (US)

( * ) Notice: Subject to any disclaimer, the term of this patent is extended or adjusted under 35 U.S.C. 154(b) by 208 days.

(21) Appl. No.: 15/276,019

(22) Filed: Sep. 26, 2016

(65) Prior Publication Data

US 2017/0096780 A1 Apr. 6, 2017

Related U.S. Application Data

(60) Provisional application No. 62/235,764, filed on Oct. 1, 2015.

(51) Int. Cl.
*E01B 27/16* (2006.01)
*E01B 27/02* (2006.01)

(52) U.S. Cl.
CPC ..... *E01B 27/028* (2013.01); *E01B 27/16* (2013.01); *E01B 2203/12* (2013.01)

(58) Field of Classification Search
CPC . E01B 1/00; E01B 27/00; E01B 27/02; E01B 27/022; E01B 27/023; E01B 27/027; E01B 27/028; E01B 27/06; E01B 27/10; E01B 27/12
See application file for complete search history.

(56) References Cited

U.S. PATENT DOCUMENTS

| | | | | |
|---|---|---|---|---|
| 6,386,114 | B1 | 5/2002 | Morgan et al. | |
| 8,245,646 | B1 | 8/2012 | Miller et al. | |
| 2005/0193918 | A1* | 9/2005 | Seyrlehner | E01B 27/00 104/10 |
| 2011/0120342 | A1* | 5/2011 | Delucia et al. | B61D 15/00 105/238.1 |
| 2014/0261048 | A1 | 9/2014 | Carter et al. | |

OTHER PUBLICATIONS

International search report and written opinion of the international searching authority for co-pending PCT application No. PCT/US2016/053722 dated Jan. 9, 2017.

* cited by examiner

*Primary Examiner* — Robert J McCarry, Jr.

(74) *Attorney, Agent, or Firm* — Baker & McKenzie LLP

(57) ABSTRACT

The present disclosure generally relates to an improved tamping operation where a rail tamping machine advances at different speeds during different stages of tamping and workhead assembly operation. The workhead assembly is also capable of moving longitudinally relative to the rail tamping machine frame when it is detected that the rail tamping machine is at an appropriate distance from a reference point. Related methods of tamping are also described.

16 Claims, 5 Drawing Sheets

HYBRID CONTINUOUS INDEXING TAMPER VEHICLE

CROSS-REFERENCE TO RELATED APPLICATION

This application claims priority to U.S. Provisional Patent Application No. 62/235,764 filed on Oct. 1, 2015, the disclosure of which is hereby incorporated by reference in entirety.

BACKGROUND

Railroads are typically constructed to include a pair of elongated, substantially parallel rails, which are coupled to a plurality of laterally extending ties. The ties are disposed on a ballast bed of hard particulate material such as gravel. Over time, normal wear and tear on the railroad may require track maintenance operations to correct rail deviations.

Rail vehicles for track maintenance operations include workheads for performing the desired track maintenance, such as spike pulling, track stabilizing, or other maintenance operations. Ballast tamping is one such maintenance operation, and is itself conventionally understood to comprise various modes of operation, such as indexing, where the tamping machine is advanced to an appropriate position with respect to the laterally extending ties, and cycling (also called "tamping"), where components associated with the workhead are driven into the ballast to a predetermined depth and "squeezed" to compact the ballast.

Historically, tamping machines have either been indexing or continuous in operation. Conventional indexing machines come to a complete stop while tamping takes place, whereas conventional continuous machines involve the main vehicle frame continuing forward during tamping and a workhead is moved independently with respect to the tamping machine. Previous improvements related to continuous tamping have been directed to maintaining the frame of the tamping machine in continuous movement, or directed to increasing the operational speed of the machine. However, these improvements increase the complexity of the system, and the gain in productivity does not always meet expectations. It is desirable to further improve tamping cycle productivity by prioritizing production speed over continuous machine movement, such that the overall productivity of the tamping cycle is improved despite deficiencies in various steps of the cycle.

BRIEF SUMMARY

The present disclosure is related to the improved operation of a rail tamping machine in order to optimize the tamping cycle. The operation includes advancing the tamping machine towards a predetermined point in relation to a laterally extended tie. When the distance between the tamping machine and the predetermined point reaches a first distance, a workhead assembly of the tamping machine is adjusted longitudinally relative to the rails in relation to the reference point. When the distance between the workhead assembly and the reference point reaches a second distance, tamping tools on the workhead assembly are driven into a predetermined depth of a rail ballast. The tamping tools will then tamp the ballast, and the workhead assembly is then raised after completing the tamping process. The work cycle may be repeated until the rail ballast tamping is complete.

The hybrid continuous indexing tamper process described herein may comprise prioritizing cycle productivity over continuous machine movement. In some embodiments, operational modifications provide for the advantageous overlap of tamping cycle stages.

BRIEF DESCRIPTION OF THE DRAWINGS

Reference is now made to the following descriptions taken in conjunction with the accompanying drawings.

DETAILED DESCRIPTION

Various embodiments for providing improved tamping cycle methods in order to perform track maintenance operations according to the present disclosure are described. It is to be understood, however, that the following explanation is merely exemplary in describing the devices and methods of the present disclosure. Accordingly, several modifications, changes and substitutions are contemplated.

Figure 1:
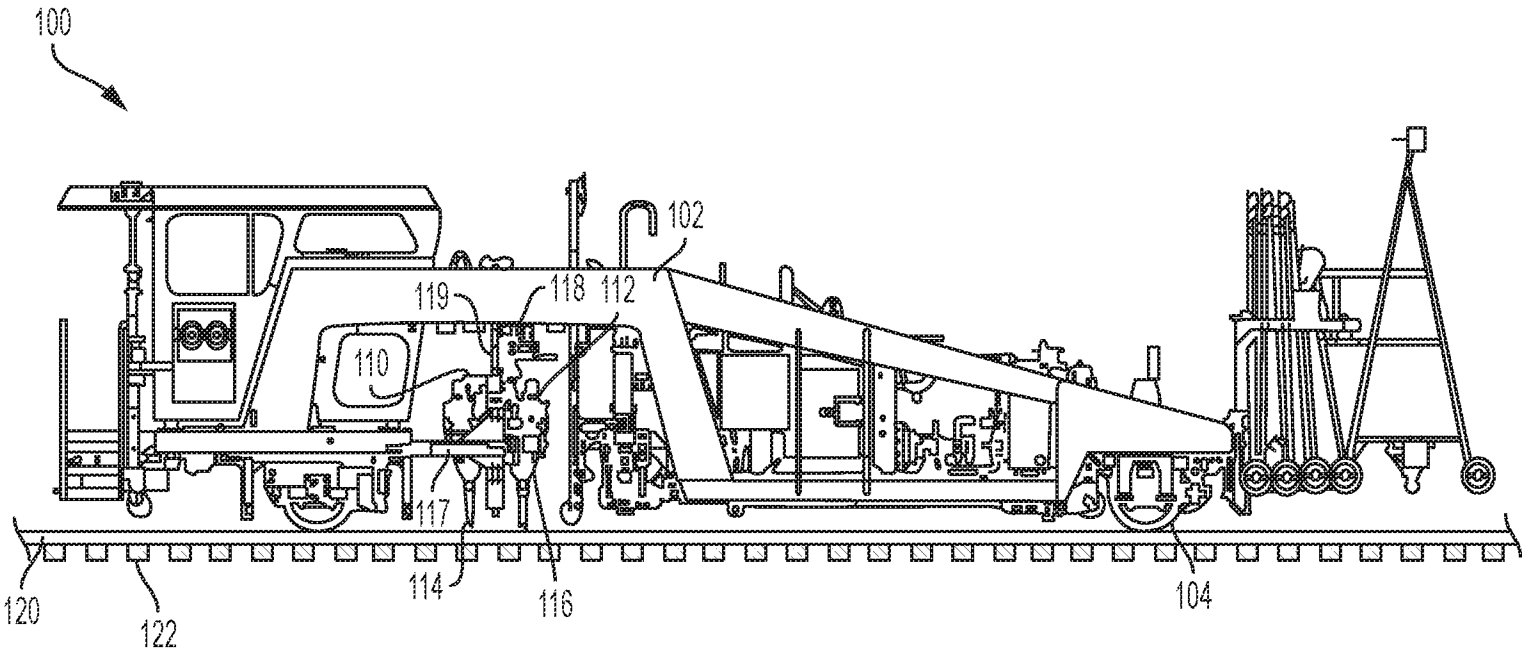
FIG. 1 illustrates a tamping vehicle for carrying out a hybrid continuous indexing process according to the present disclosure.

A rail vehicle operable to implement a hybrid continuous indexing (HCI) tamping process according to the present disclosure is illustrated in FIG. 1. The rail vehicle may take the form of a tamping vehicle 100 that includes a frame assembly 102 and a workhead assembly 110. The frame assembly 102 includes a plurality of rigid frame members and a plurality of wheels 104 that are configured to travel on a pair of rails 120. The tamping vehicle 100 travels along the pair of rails 120 that is disposed over a series of rail ties 122. The rails 120 and the series of rail ties 122 are disposed over a ballast bed of hard particulate material, such as gravel.

The workhead assembly 110 may include multiple workheads. In FIG. 1, one workhead 112 can be viewed while another workhead is also included at an opposite side corresponding with the other rail. Any number of workheads (2, 4, etc) may be included and include similar parts. The workhead 112 includes tamping tools 114 that are lowered into the ballast. The tamping tools 114 may be paddles, contact plates, or other appropriate instruments capable of tamping ballast. The tamping tools 114 may be vibrated by vibrators 116 to compact ballast. The workhead assembly 110 is coupled to the frame assembly 102 via a subframe 118 and an actuator 119. The actuator 119 is preferably a hydraulic actuator and is operable to lower the workhead assembly 110 such that the tamping tools 114 are inserted into the ballast where the squeezing and vibration action tamps the ballast. The workhead assembly 110 and its workheads 112 are also operable to move longitudinally relative to the frame assembly 102 and the rails 120. The workhead assembly 110 may be guided by longitudinal guides 117, and be driven by longitudinal actuators (not shown).

Figure 2:
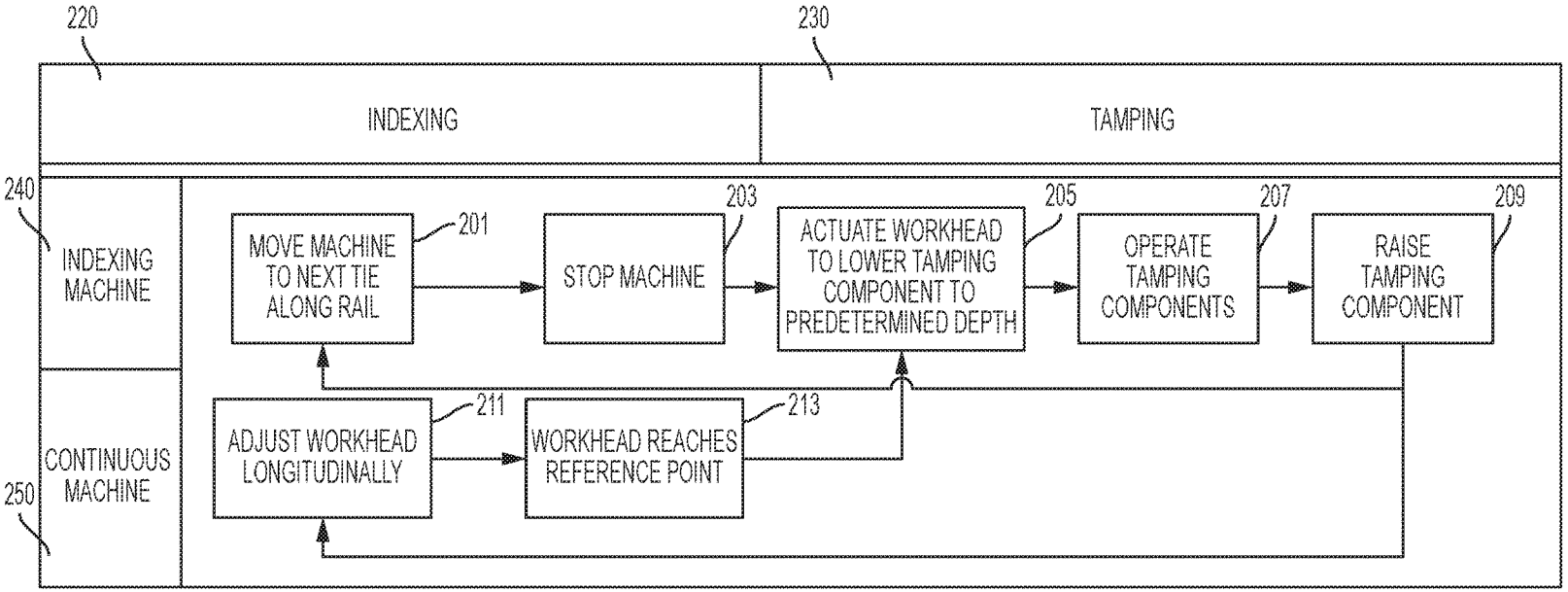
FIG. 2 illustrates conventional methods of operating indexing tamping vehicles and continuous tamping vehicles.

Two types of conventional methods of tamping will now be described with reference to FIG. 2. With a conventional indexing machine 240, a work cycle begins at an indexing phase 220 during which the tamping vehicle 100 moves along the rails (step 201). At an appropriate location, the tamping vehicle 100 stops (step 203). During a tamping phase 230, the workhead assembly is lowered to a predetermined depth (step 205). The tamping tools 114 on the workhead assembly 110 are then operated to tamp the ballast (step 207) and then raised (and in some cases stowed away) after tamping is complete (step 209). The tamping vehicle 100 then returns to the indexing phase 220 and travels to the next rail tie and the work cycle is repeated.

With a conventional continuous machine 250, the tamping vehicle 100 moves continuously along the rails 120 at a constant speed during a work cycle. During the indexing phase 220 of the work cycle, the workhead assembly 110 is moved longitudinally relative to the tamping vehicle frame 102 (step 211) as the tamping vehicle continues forwards. When the workhead assembly 110 reaches a reference point, e.g. rail tie, (step 213), the work cycle enters the tamping phase 230 and the actuator 118 is actuated to lower the workhead assembly to a predetermined depth (step 205). The tamping tools 114 on the workhead assembly 110 are then operated to tamp the ballast (step 207), after which the tamping components are raised from the ballast (step 209).

In contrast to the above described conventional methods, HCI operation according to the principles of the present disclosure provides for overlap phases that are limited in operation, such that the indexing and tamping phases are combined in a manner that is accurately predictable. For example, by configuring the workhead assembly 110 to move longitudinally during the tamping cycle instead of only during the indexing cycle, HCI replaces the typically "smooth operation" of the conventional continuous tamping methods, and increases efficiency of the tamping process.

Hybrid Continuous Indexing (HCI)

Figure 3:
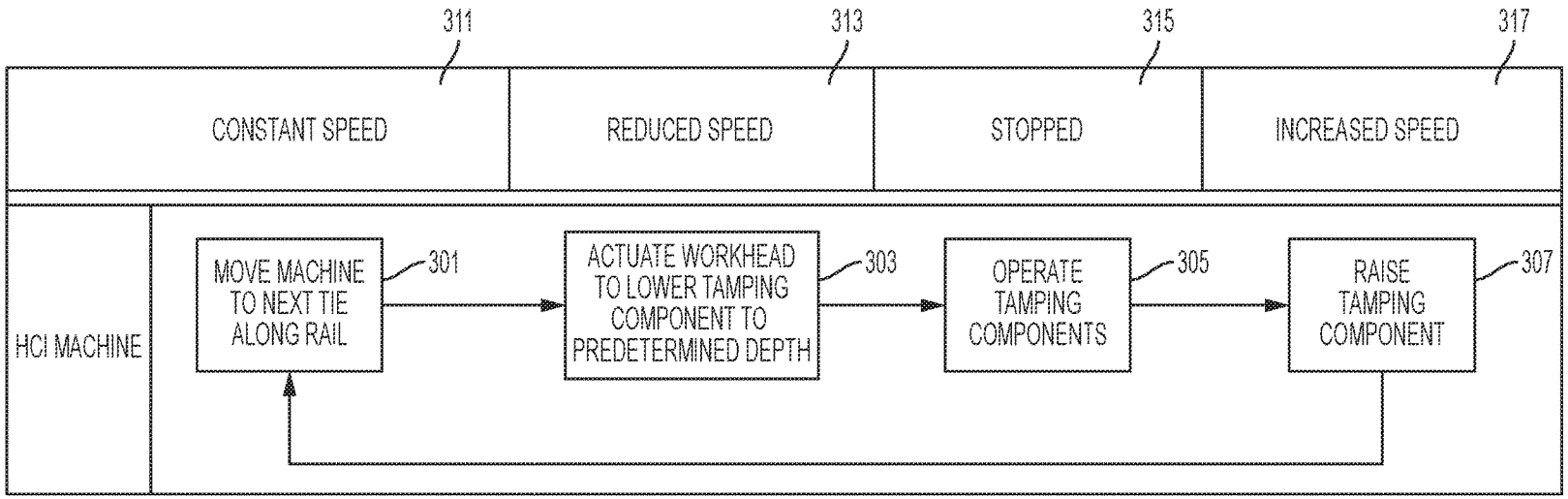
FIG. 3 illustrates a hybrid continuous indexing tamping process according to one embodiment of the present disclosure.

In one embodiment of HCI operation, the workhead assembly 110 is configured to move longitudinally in relation to the vehicle frame 102 during the tamping phase. Configuring the workhead assembly 110 to move in this manner requires significantly reducing the speed of the tamping vehicle 100 when compared to the speed conventionally used for operating a continuous machine. The tamping vehicle 100 may also be configured to stop its forward motion for a portion of the HCI operation in a manner that is distinguishable from continuous machines, as illustrated by FIG. 3.

A work cycle of a tamping vehicle 100 implementing an embodiment of HCI operation begins at step 301, where the tamping vehicle is moved along the rails to an appropriate rail tie at a constant speed 311. During this phase, the tamping vehicle 100 is operable to track the distance between a predetermined point (e.g., a rail tie or other reference point) and both the tamping vehicle and the workhead assembly 110. At a first determination that the tamping vehicle 100 is at an appropriate distance from the predetermined point, the tamping vehicle begins to decelerate and travel at reduced speed 313. At a second determination that the workhead assembly 110 is at an appropriate distance from the reference point while the tamping vehicle 100 is traveling at reduced speed 313, the actuator 118 is actuated to lower the workhead assembly 110 to thereby lower the tamping tools 114 to a predetermined depth of the ballast (step 303). The tamping vehicle 100 then comes to a complete top 315 and the tamping tools 114 on the workhead assembly 110 are operated to tamp the ballast (step 305).

When the tamping at that specific location is complete, the tamping vehicle 100 begins forward motion and accelerates and travels at increased speed 317 and moves on to the next rail tie while the actuator 118 simultaneously raises the tamping tools 114 and the workhead assembly (step 307) from the ballast. The tamping work cycle then repeats as long as tamping is needed along the rails 120. Notably, the tamping vehicle 100 may alternatively begin to operate at a reduced speed at the second determination instead of the first determination.

As disclosed above in the HCI operation, the tamping vehicle 100 comes to a complete stop during a portion of the tamping phase. This distinguishes the HCI operation from methods implemented by conventional continuous machines. Indeed, reducing efficiency for a portion of the tamping cycle, such as where the speed of the tamping vehicle 100 is reduced or stopped during the tamping phase, actually results in an increase in overall productivity when compared to continuous operation. In a conventional continuous tamping operation, productivity is reduced by the variable and unpredictable amount of time needed for workhead components to be lowered to a predetermined squeeze depth for ballast compaction. This unpredictability was conventionally understood to be tolerable in light of the various provided benefits, such as smooth machine operation for the operator and increased production rates. However, reducing efficiency for a portion of the cycle such as by reducing machine speed, or even by bringing the machine to a complete stop, nonetheless results in an increase in overall productivity as it reduces or eliminates the variability associated with lowering the workheads. Furthermore, though HCI operation introduces unpredictability by providing alternative modes of operation when compared to the distinct transition between the indexing phase 220 and the tamping phase 230, this unpredictability is based upon speed parameters that themselves are accurately predictable.

Overlapping Tamping Stages

Figure 4:
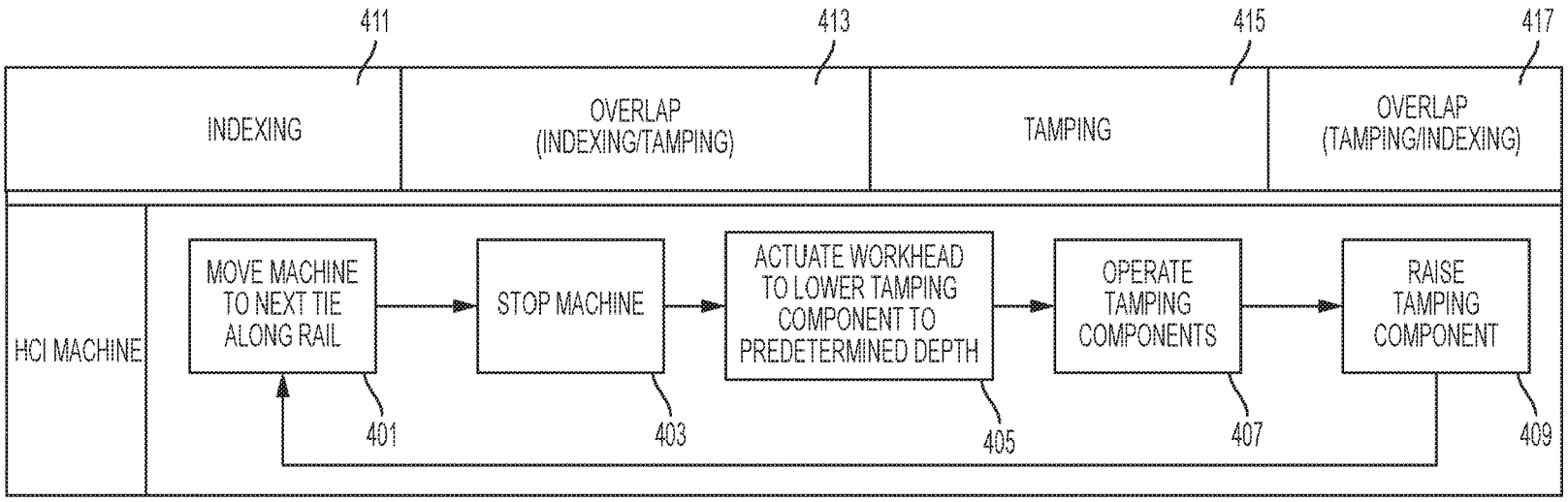
FIG. 4 illustrates a hybrid continuous indexing tamping process according to another embodiment of the present disclosure.

Another embodiment of the HCI operation is described with reference to FIG. 4. Various system components are configured to operate according to parameters that lie outside of the normal range of operation, advantageously resulting in the overlap of the indexing and tamping stages of the tamping cycle. In contract to conventional indexing and continuous machines, HCI operations provides for overlap phases that are limited in operation, such that the indexing and tamping phases are combined in a manner that is accurately predicable.

A work cycle of a tamping vehicle implementing this embodiment of HCI operation begins at step 401 where the tamping vehicle 100 is moved along the rails to an appropriate rail tie during an indexing phase 411. At this phase, the tamping vehicle 100 is operable to track the distance between a predetermined point and each of the tamping vehicle and the workhead assembly 110. At a first determination that the tamping machine is at an appropriate distance from the predetermined point, the indexing and tamping phases overlap, and the tamping machine 100 is brought to a stop while the workhead assembly moves longitudinally relative to the vehicle frame 102 and in reference to the predetermined point (step 403). At a second determination that the workhead assembly 110 is at an appropriate distance from the reference point while the tamping machine is stopped, the actuator 118 is actuated to lower the tamping tools 114 to a predetermined depth (step 405) while the work cycle transitions from the first indexing/tamping overlap phase 413 to the tamping phase 415. The tamping components 114, such as paddles, are then operated to tamp the ballast (step 407) during the tamping phase 415. When tamping at the specific location is complete, the tamping components are then raised (step 409) at a second indexing/ tamping overlap phase 417. Advantageously, operating in accordance with HCI requires only a small range of longitudinal motion by the workhead assembly 110 when compared to continuous machines.

A significant problem for conventional continuous tamping vehicles involves preventing the distance between a measured reference point and the location of tamping from becoming too great. Since measuring components and tamping components on the tamping vehicle operate in part based on measured reference points related to the rail ties, allowing these components to remain stationary relative to the frame is advantageous because it limits the impact of longitudinal workhead motion. In one embodiment of the methods described herein, longitudinal workhead motion will be limited to be less than six inches during a cycle. The remainder of the longitudinal motion occurs after cycling is complete.

Figure 5:
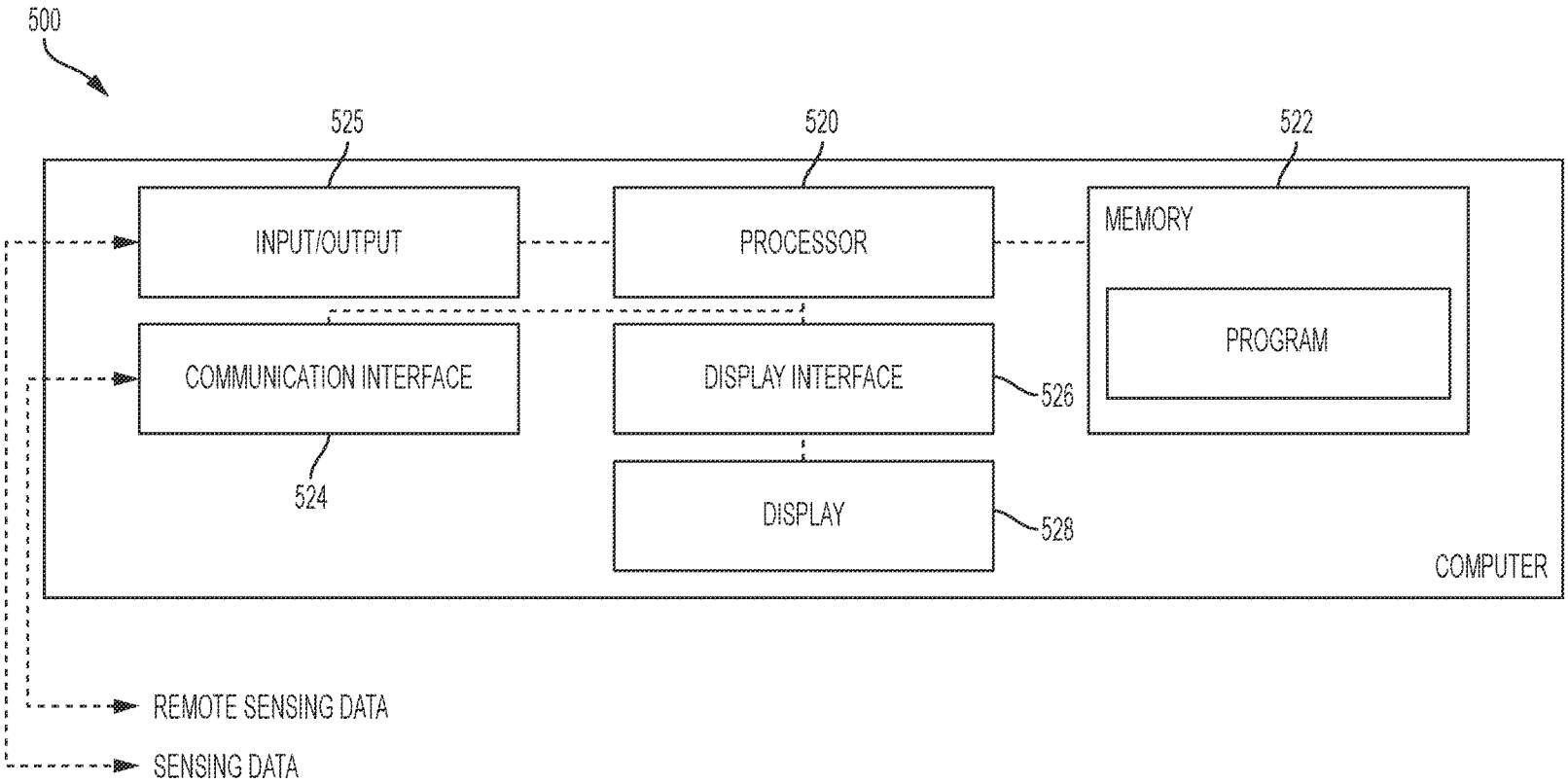
FIG. 5 illustrates a computing system associated with the tamping vehicle of FIG. 1 and for use in carrying out the processes described herein.

Referring to FIG. 5, the tamping vehicle 100 may be equipped with a computing system may take the form of a computer or data processing system 500 that includes a processor 520 configured to execute at least one program stored in memory 522 for the purposes of performing one or more of the processes disclosed herein. The processor 520 may be coupled to a communication interface 524 to receive remote sensing data, such as detection of a tie or other reference point, as well as transmit instructions to receivers distributed throughout the tamping vehicle 100, such as to the workheads during tamping operations. The processor 520 may also receive and transmit data via an input/output block 525. In addition to storing instructions for the program, the memory may store preliminary, intermediate and final datasets involved in techniques that are described herein. Among its other features, the computing system 500 may include a display interface 526 and a display 528 that displays the various data that is generated as described herein. It will be appreciated that the computing system 500 shown in FIG. 5 is merely exemplary in nature and is not limiting of the systems and methods described herein.

The above described embodiments of hybrid continuous indexing (HCI) provide numerous benefits. For example, the risk of causing high longitudinal loads to workhead assembly components such as workhead guide rods as well as track is eliminated, even when HCI operation takes place at a high rate of speed. Furthermore though the frequency of the tamping cycle is increased in HCI operation when compared to conventional methods, machine motion is not increased such that operator performance is significantly affected. Also, the decreased operational distance for the workhead assembly reduces the number of design challenges; for example, simplified hydraulic routing as well as other factors result in the negligible impact on machine length. Finally, though tamping cycle frequency increases in the disclosed HCI methods, the motion of the tamping machine is not more violent. In an embodiment, the frequency increases from a cycle every three seconds to a cycle every two seconds. And the impact of higher production speeds on the operator can be adequately addressed by various mitigation methods.

While various embodiments in accordance with the disclosed principles have been described above, it should be understood that they have been presented by way of example only, and are not limiting. Indeed, in some embodiments, the principle of hybrid continuous action indexing motion may be applied to other rail maintenance operations such as spike pulling. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

What is claimed is:

1. A method for operating a tamping machine in a rail application, comprising moving the tamping machine towards a rail tie at a constant speed;

reducing the speed of the tamping machine and actuating a workhead assembly to lower one or more tamping components to a predetermined depth when the tamping machine is at a reduced speed relative to the constant speed;

stopping movement of the tamping machine and operating the one or more tamping components when the tamping machine is stopped; and increasing the speed of the tamping machine and raising the one or more tamping components from the predetermined depth when the tamping machine is increasing speed.

2. The method of claim 1, wherein the workhead assembly moves longitudinally relative to a frame of the tamping machine.

3. The method of claim 1, further comprising moving the workhead assembly longitudinally relative to a frame of the tamping machine when the tamping machine is moving at the constant speed.

4. The method of claim 1, further comprising moving the workhead assembly longitudinally relative to a frame of the tamping machine when the tamping machine is moving at the reduced speed relative to the constant speed.

5. The method of claim 1, wherein the operating the tamping components includes tamping ballast around the rail tie by vibrating the tamping components.

6. The method of claim 5, wherein operating the tamping components further includes moving the tamping components to squeeze the ballast.

7. The method of claim 1, further comprising moving the workhead assembly longitudinally relative to the frame of the tamping machine when the tamping machine is increasing speed.

8. The method of claim 4, wherein the workhead assembly is operable to move longitudinally relative to the frame of the tamping machine within a range of six inches.

9. A method for operating a tamping machine in a rail application, comprising:

moving the tamping machine towards a rail tie;

bringing the tamping machine to a stop, while simultaneously moving the workhead assembly longitudinally in the direction of machine movement and relative to a frame of the tamping machine, when the indexing phase and a tamping phase overlap at an overlap phase;

actuating a workhead assembly to lower one or more tamping components to a predetermined depth during an end of the overlap phase;

operating the one or more tamping components during the tamping phase; and raising the one or more tamping components from the predetermined depth when the tamping phase overlaps with a subsequent indexing phase at a subsequent overlap phase.

10. The method of claim 9, wherein the workhead assembly moves longitudinally relative to a frame of the tamping machine during the indexing phase and the subsequent indexing phase.

11. The method of claim 9, wherein the workhead assembly moves longitudinally relative to the frame of the tamping machine within a range of six inches.

12. The method of claim 9, wherein the tamping machine moves toward a subsequent rail tie during the subsequent indexing phase.

13. The method of claim 9, wherein the operating the one or more tamping components includes tamping ballast around the rail tie by vibrating the tamping components.

14. The method of claim 13, wherein operating the tamping components further includes moving the tamping components to squeeze the ballast.

15. The method of claim 13, wherein the operating the one or more tamping components is completed when tamping the ballast is completed.

16. The method of claim 15, wherein the subsequent indexing phase begins when the operating the one or more tamping components is completed.

* * * * *